US005748743A

United States Patent [19]

Weeks

[11] Patent Number: 5,748,743

[45] Date of Patent: May 5, 1998

[54] AIR CONDUCTION HEARING DEVICE

[75] Inventor: Eric L. Weeks, Manchester, Me.

[73] Assignee: Ear Craft Technologies, Boothbay, Me.

[21] Appl. No.: 386,518

[22] Filed: Feb. 6, 1995

Related U.S. Application Data

[63] Continuation-in-part of Ser. No. 26,545, Aug. 1, 1994, Pat. No. Des. 367,113.

[51] Int. Cl.[6] ..... H04R 25/00

[52] U.S. Cl. ..... 381/68.6; 381/68; 381/69

[58] Field of Search ..... 381/68, 68.2, 68.4, 381/68.6, 69; 181/126, 128, 129, 130; 128/746; D24/174

[56] References Cited

U.S. PATENT DOCUMENTS

| | | | |
|---|---|---|---|
| 3,124,663 | 3/1964 | Beaudry | 381/69 |
| 3,374,318 | 3/1968 | Martin | 381/68.6 |
| 3,852,540 | 12/1974 | Diethelm | 179/107 |
| 3,983,336 | 9/1976 | Malek et al. | 381/68.6 |
| 4,073,366 | 2/1978 | Estes | 381/69 |
| 4,456,795 | 6/1984 | Saito | 179/107 |
| 4,532,649 | 7/1985 | Bellafiore | 381/69 |
| 4,706,778 | 11/1987 | Topholm | 181/135 |
| 4,716,985 | 1/1988 | Haertl | 181/130 |
| 4,739,512 | 4/1988 | Hartl et al. | 381/68.6 |
| 4,831,655 | 5/1989 | Buettner | 381/69 |
| 4,852,177 | 7/1989 | Ambrose | 381/154 |
| 4,879,750 | 11/1989 | Nassler | 381/68.6 |
| 4,953,215 | 8/1990 | Weiss et al. | 381/68 |
| 4,977,976 | 12/1990 | Major | 181/130 |
| 4,984,277 | 1/1991 | Bisgaard et al. | 381/69.2 |
| 4,985,925 | 1/1991 | Langberg et al. | 381/71 |
| 4,987,597 | 1/1991 | Haertl | 381/69 |
| 5,046,580 | 9/1991 | Barton | 181/135 |
| 5,185,802 | 2/1993 | Stanton | 381/68.6 |
| 5,201,008 | 4/1993 | Arndt et al. | 381/68.6 |
| 5,327,500 | 7/1994 | Campbell | 381/68 |

FOREIGN PATENT DOCUMENTS

| | | | |
|---|---|---|---|
| 9325053 | 12/1993 | WIPO | 381/68 |

*Primary Examiner*—Curtis Kuntz
*Assistant Examiner*—Xu Mei
*Attorney, Agent, or Firm*—Randy W. Lacasse

[57] ABSTRACT

A two-piece hearing aid with a soft flexible snap-on covering with a plurality of folding sections which contribute to the proper fit, comfort, ease of maintenance and prevention of earwax build-up interference. The end of the snap-on insert has a thin sound permeable membrane which does not allow earwax into the hearing aid. In addition, a directional windramp redirects wind away from the microphone opening to greatly reduce ambient wind noise.

19 Claims, 3 Drawing Sheets

AIR CONDUCTION HEARING DEVICE

BACKGROUND OF THE INVENTION

1. Field of Invention

This application is a continuation-in-part of U.S. application Ser. No. 29/026,545, filed Aug. 1, 1994, now U.S. Pat. No. D 367,113. This invention relates to hearing aids and more particularly to a unique two-piece structure with improvements to eliminate poor ear canal fit, ambient wind noise and earwax interference.

2. Discussion of Prior Art

The first electronic hearing aids were relatively large devices, usually with the electronics remotely connected (i.e. hung around the neck, placed in a shirt pocket or attached to a belt). Typically, a case holding the electronics would be worn by the user with a connection up and into the ear canal.

Hearing aids soon developed into small devices that moved the electronics into a small casing which was worn behind the ear. Most recently developments have miniaturized the electronics such that the entire device fits into the inner ear or canal.

While miniaturization of hearing aids has benefited the aesthetics of hearing aids, very few major advancements have been made with respect to internal fit, wind noise and the prevention of wax build-up interfering with the transference of sound.

Three basic techniques are typically used to provide for fitting hearing aids into the ear canal. The first technique involves the very costly and time consuming process of custom designing the shell by making an internal ear canal mold. The mold is then used to form the outer shell of the hearing aid. The second technique is to design the outer shell of a hearing aid to fit the general size and shape of a typical ear canal. The manufacturer may supply a discrete number of sizes reflecting their preferred shape. The third technique has a small insert which typically fits the general opening of an ear canal but does not fit down into the canal itself.

The patent to Haertl, U.S. Pat. No. 4,716,985 illustrates an example of the first technique (see column 1, etc.). The following U.S. Pat. Nos. 4,532,649; 4,706,778; 4,852,177; 4,984,277 and 5,185,802 are examples of the second technique. U.S. Pat. Nos. 5,046,580; 4,456,795 and 4,977,976 are examples of the third technique.

The prior art is deficient with respect to corrective techniques for wind noise. Wind noise remains a problem which has very few solutions. Severe wind noise may prevent the user from keeping the volume at a proper level. Due to the loud noises created and masking of directive sound waves, a user will either turn down the volume or not use the device at all. The patent to Beaudry (U.S. Pat. No. 3,124,663) alludes to raising or lowering the opening of the microphone and illustrates use of a cylindrical tube.

A number of patents have attempted to solve wax build-up interference with the use of a mesh screen, end-cap or porous membrane with a small channel or plurality of parallel channels located therein. Prior art examples of these attempts are the patents to Haertl (U.S. Pat. No. 4,987,597), Stanton (U.S. Pat. No. 5,185,802), Bisgaard et al. (U.S. Pat. No. 4,984,277), Weiss et al. (U.S. Pat. No. 4,953,215), Nassler (U.S. Pat. No. 4,879,750), Ambrose (U.S. Pat. No. 4,852,177), Haertl et al. (U.S. Pat. Nos. 4,739,512 and 4,716,985), Topholm (U.S. Pat. No. 4,706,778), Bellafiore (U.S. Pat. No. 4,532,649), Diethelm (U.S. Pat. No. 3,852,540) and Martin (U.S. Pat. No. 3,374,318). Each prior art attempt to prevent the interference of built-up earwax uses some type of semi-permeable barrier (i.e. vented caps). In addition to the deficiency of requiring some form of opening to allow for the transference of sound, many of these solutions require extreme dexterity to remove and replace such a tiny barrier. As hearing aids may be worn by those whose dexterity may not be sufficient to perform such a task, regular cleaning may not be performed as necessary.

What is needed is an easy-to-use, form fitting, hearing aid with a wind noise suppressor and a sound-permeable wax retardant barrier for the sound conduction path.

SUMMARY OF THE INVENTION

Objects of the Invention

It is an object of the present invention to make a unique two-piece hearing aid.

It is further an object of the invention to make a hearing aid which is comfortable and fits snugly within the ear.

It is also an object of the present invention to make an off-the-shelf device which is dynamically adjustable to fit varying canal sizes.

It is further an object of the invention to eliminate ambient wind noise.

It is further an object of the present invention to provide for a hearing aid which prevents the build-up of earwax from interfering with the proper operation of the hearing aid.

It is an additional object of the invention to make a hearing aid easy to maintain.

It is also an object of the present invention to make a low cost device.

These and other objects will be discussed in detail hereafter as provided for in the drawings, detailed specification and claims.

These objects are achieved in the present invention by providing a two-piece hearing aid with a soft flexible snap-on covering which contributes to the proper fit, comfort, ease of maintenance and prevention of earwax build-up interference. The end of the snap-on insert has a thin sound permeable membrane which does not allow earwax into the hearing aid. In addition, a directional windramp redirects wind away from the microphone opening to greatly reduce ambient wind noise.

DETAILED DESCRIPTION

Figure 1:
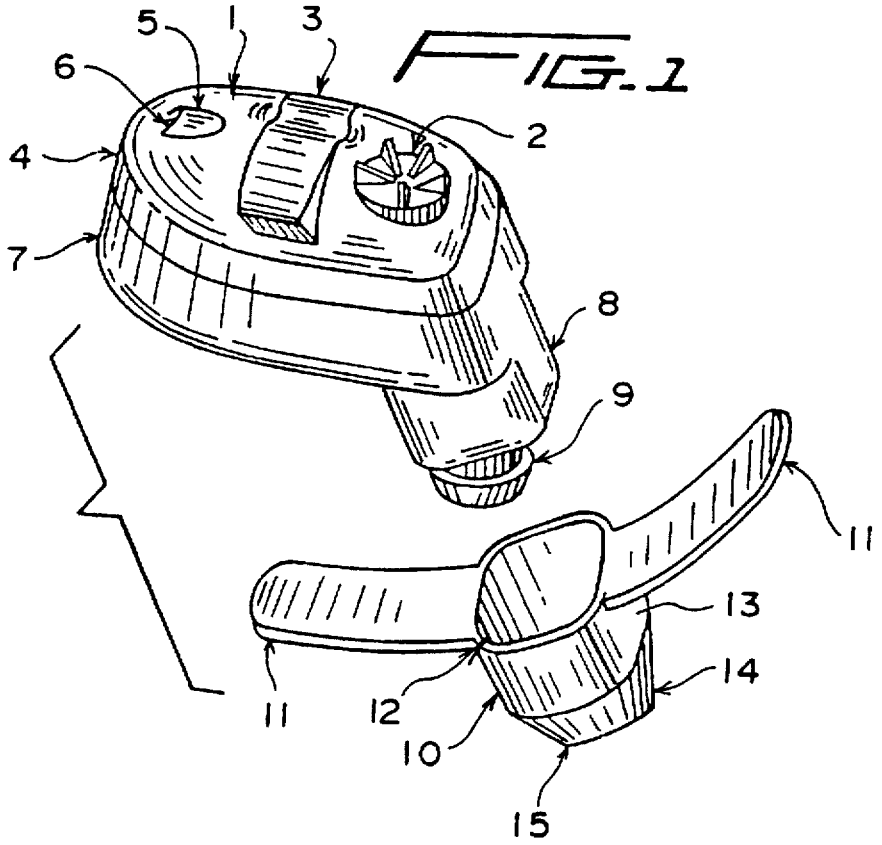
FIG. 1, illustrates an exploded view of the two piece hearing aid of the present invention.

In accordance with the instant invention, FIG. 1 illustrates the general configuration of a two-piece in-the-ear hearing aid. The hearing aid assembly 1 consists of a top section 4 and bottom section 7. The assembly is made of injection-molded thermoplastic, but could be adequately made out of other equivalent materials. Sections 4 and 7 are snap-fit together but could also be glued, screwed or attached by other known methods.

Figure 9:
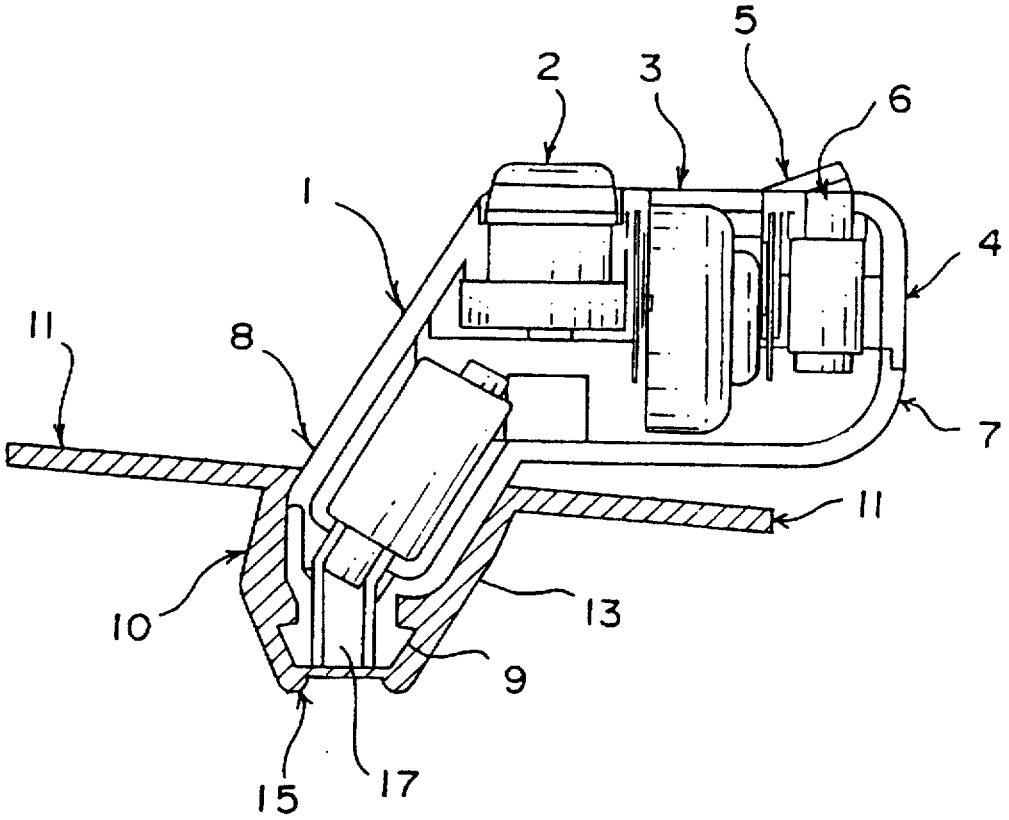
FIG. 9, illustrates an internal cut-away of the device with tip connected.

The assembly encapsulates the air conduction electronics which provide for the amplification and control of the hearing aid(See FIG. 9).The particular electronics are not part of the present invention. Suitable electronics could be used which would satisfy the internal physical configuration of the assembly. The electronic characteristics should generally be in the range of 20 db at 60 db spl - input and 107 db spl at 3 Kz - output, but should not be limited thereto.

Top section 4 contains the external controls, battery replacement opening and microphone input. Volume control knob 2 provides for easy access to volume adjustment. Battery compartment 3 is a conventional hinged battery door which flips up for replacement of a conventional 1.4 Volt, no. 312 battery. Wind ramp 5 provides for a directional deflector for microphone opening 6. The wind ramp alleviates previous prior art problems associated with ambient wind noise with a significant reduction thereof.

Bottom section 7 consists of a top section which, as previously discussed above, connects to upper section 4 and a downwardly extending ear canal section 8. Attached to the end of section 8 is head section 9 with a sound conduction opening 15. A sound conduction channel 17 runs from the electronics through section 8 to the opening 15.

Figure 2:
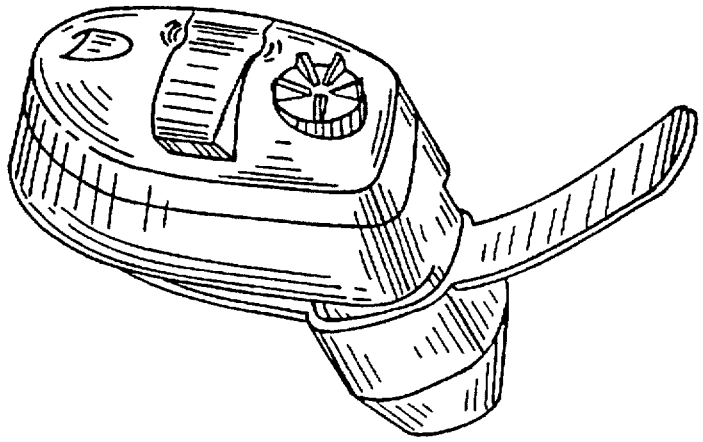
FIG. 2, illustrates a side view of the two piece hearing aid of the present invention connected for use.
Figure 3:
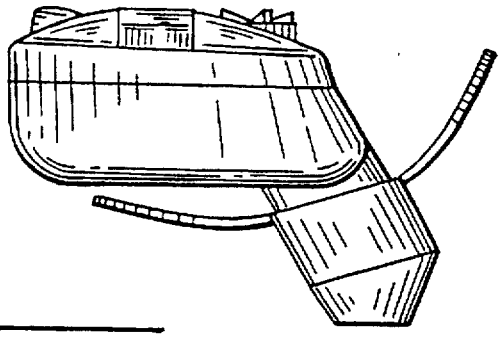
FIG. 3, illustrates a right side view of the two piece hearing aid of the present invention.
Figure 4:
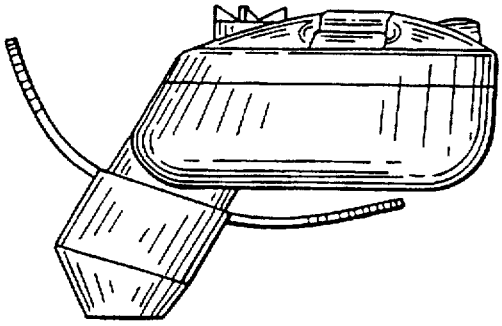
FIG. 4, illustrates a left side view of the two piece hearing aid of the present invention.
Figure 5:
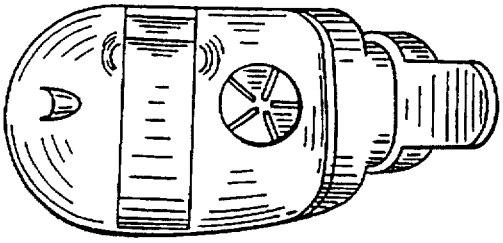
FIG. 5, illustrates a top view of the two piece hearing aid of the present invention.
Figure 6:
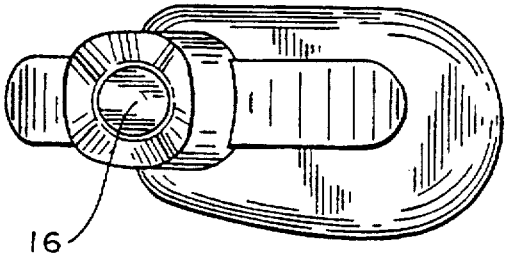
FIG. 6, illustrates a bottom view of the two piece hearing aid of the present invention.
Figure 7:
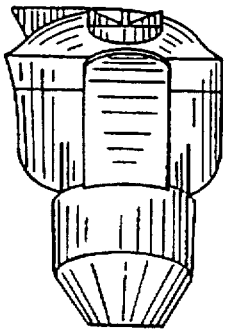
FIG. 7, illustrates a front view of the two piece hearing aid of the present invention.
Figure 8:
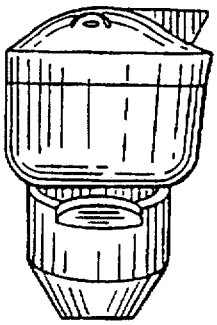
FIG. 8, illustrates a rear view of the two piece hearing aid of the present invention.

Section 10 is a soft flexible ear tip which snaps onto the head section 9 and section 8. Although not shown, section 8 and the tip may be ribbed to provide for both compressional and friction retention. The tip is preferably made of silicon but can be made of any suitable equivalent material (e.g. rubber) which provides for flexibility, durability, softness and moisture resistance. A typical durometer rating of 60 is preferred, but the invention should not be limited thereto. The tip consists of a hearing aid receiving section 12 which receives section 8 as previously described above. Flaps 11 provide the means with which to grasp the tip and further fold upwardly when the device, as shown in FIG. 2, is inserted into the ear canal to provide for a snug fit to the canal and its opening. The tubular mid-section of the tip 13 tapers to an end section 14 which encapsulates a membrane 16 (shown in FIG. 6). The tip may be prefabricated in a plurality of sizes which may be selected according to the internal size of a user's ear canal.

The membrane 16 provides for the through conduction of amplified sound coming from channel 17, but prevents the throughput of earwax into the hearing aid assembly.

The major features of the membrane are as follows:

1. An integral membrane diaphragm which prevents ear wax from plugging the hearing port and/or infiltrating the hearing device and damaging the devices electronics and micro speaker. Attempts to clean the hearing port, electronics or micro speaker frequently damage the device irreparably. The integral membrane can be an added piece but is preferably molded as an integral part of the tip itself.
2. The integral membrane diaphragm should be as thin as possible in order to minimize attenuation of the amplified sound from the micro speaker in the hearing aide device to the user's ear drum. The membrane must be less than 0.010" thick and ideal performance occurs with membranes below 0.001" thick.
3. The hearing aid tip and integral membrane diaphragm should be made from a soft compliant material such as a rubber or thermoplastic elastomer. The durometer of the elastomer should be soft enough to allow:
   a) the tip to stretch over the receiving end of the hearing aid device.
   b) provide an air tight seal between the inner ear and the hearing aid device.
   c) a level of compression against the inner ear canal so as to be comfortable enough to where for long periods of time.
   d) A Shore A scale durometer of less than 60 is desirable.
4) The hearing aid tip and integral membrane diaphragm can also incorporate integral molded straps 11 to allow the tip to be easily mounted and removed from the hearing aid device and to allow easy removal from the ear canal if it were to be accidentally separated from the hearing aid device. The straps also provide additional soft interface between the device and the ear.
5) The hearing aid tip and hearing aid device can be made in such a fashion to provide a mutual fit which securely mounts the tip when the device is in the ear canal, yet allows the tip be easily mounted and removed from the hearing aid device when the device is not in the ear. This can be accomplished by providing an mating fit between the two parts so that the tip must be substantially stretched over a mating ring on the device. The amount of stretch and interference should be substantial enough so that when the device and tip are in the ear canal the two parts are contained by the ear canal and cannot be separated.
6) The sizing of the tip and the receiving portion of the hearing aid device can be constructed in such a way as to stretch the membrane substantially when mounted, creating a membrane thickness substantially less than the membrane of the tip prior to mounting.

To use the hearing aid the following steps should be followed:

1. Have ear canal measured to determine size of tip 10.
2. Select appropriate tip.
3. Have hearing measured.
4. Select appropriate electronics settings for proper amplification range.
5. Attach tip.
6. Insert battery.
7. Set initial volume setting.
8. Insert into ear folding flaps 11 backward.
9. Removal—pull on section 1/4 with 10 attached.
10. If hearing aid becomes dislodged from tip, pull tip from ear using flaps 11.

CONCLUSION

A system and method has been shown in the above embodiments for a unique two-piece hearing aid which provides for a form fit, reduction in ambient wind noise, is small in size, easy to maintain and eliminates earwax migration into the hearing aid. While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. An electronic hearing aid which is insertable into an ear canal comprising:

a first section having a top part containing input and control elements;

said first section tapering to a bottom part and encapsulating amplification circuitry and sound conduction channels;

a second tubular flexible section removably connectable to said first section and comprising a first end having a receiving opening for partially receiving the bottom part of said first section, a plurality of distending sections and a second end having a tapered and sealed distal end comprises a thin sound conduction membrane integrated within said distal end, a plurality of flaps attaching to said first end, and wherein said second tubular flexible section is attached to said first section and the combination is insertable into the ear canal of a user with the plurality of distending sections and the plurality of flaps folded backwardly upon insertion.

2. An electronic hearing aid as per claim 1, further wherein said input and control elements located in said top part of said first section comprises a microphone including a sound input opening.

3. An electronic hearing aid as per claim 2, further comprising a wind deflector means at least partially circumferentially surrounding said sound input opening.

4. An electronic hearing aid as per claim 1, wherein said top part of said first section further contains a battery compartment, volume adjuster and microphone opening.

5. An electronic hearing aid as per claim 4, further comprising a wind deflector means at least partially circumferentially surrounding said microphone opening.

6. An electronic hearing aid as per claim 1, wherein said second tubular flexible section is made of silicon or equivalent material.

7. An electronic hearing aid as per claim 1, wherein the bottom part of said first section and the receiving opening of said second tubular flexible section are textured to increase adhesion upon attachment thereof.

8. An electronic hearing aid as per claim 1, wherein said second tubular flexible section may be removed from the ear canal of the user using the distending sections if said first and second sections become unattached while in the ear canal.

9. An electronic hearing aid as per claim 1, wherein said membrane thickness is 0.01–0.001 inches thick.

10. An electronic hearing aid which is inserted into an ear canal comprising:

a first section having a top part containing input and control elements;

said first section tapering to a bottom part and encapsulating amplification circuitry and sound conduction channels;

a second flexible section removably connectable to said first section and comprising:

a first end having a receiving opening for partially receiving the bottom part of said first section;

a tubular mid-section;

a second end having a tapered and sealed end section, wherein said sealed end section comprises a thin sound conduction membrane integral therewith;

a plurality of flaps attaching to said first end, and wherein said second flexible section is attached to said first section and the combination is insertable into the ear canal of a user with the plurality of flaps folded backwardly upon insertion.

11. An electronic hearing aid as per claim 10, further wherein said input and control elememnts located in said top part of said first section comprises a microphone including a sound input opening.

12. An electronic hearing aid as per claim 11, further comprising a wind deflector means at least partially circumferentially surrounding said sound input opening.

13. An electronic hearing aid as per claim 10, wherein said top part of said first section further contains a battery compartment, volume adjuster and microphone opening.

14. An electronic hearing aid as per claim 13, further comprising a wind deflector means at least partially circumferentially surrounding said microphone opening.

15. An electronic hearing aid as per claim 10, wherein said second flexible section is made of silicon or equivalent material.

16. An electronic hearing aid as per claim 10, wherein the bottom part of said first section and the receiving opening of said second section are textured to increase adhesion upon attachment thereof.

17. An electronic hearing aid as per claim 10, wherein said second flexible section may be removed from the ear canal of the user using the flaps if said first and second sections become unattached while in the ear canal.

18. An electronic hearing aid as per claim 1, wherein said membrane thickness is 0.01–0.001 inches thick.

19. A two-piece electronic hearing aid which is wholly insertable into an ear canal of a user comprising:

a first section having a top part containing a microphone opening, wind deflector, battery compartment and volume control;

said first section tapering to a bottom part and encapsulating amplification circuitry and sound conduction channels;

a second flexible section removably connectable to said first section and comprising:

a first end having a receiving opening for partially receiving the bottom part of said first section;

a tubular mid-section;

a second end having a tapered and sealed end section, wherein said sealed end section comprises a thin sound conduction membrane integral therewith;

a plurality of flaps, attaching to said first end and wherein said second flexible section is attached to said first section and the combination is insertable into the ear canal of a user with the plurality of flaps folded backwardly upon insertion.

* * * * *

UNITED STATES PATENT AND TRADEMARK OFFICE

CERTIFICATE OF CORRECTION

PATENT NO. : 5,748,743

DATED : May 5, 1998

INVENTOR(S) : Eric L. Weeks

It is certified that error appears in the above-identified patent and that said Letters Patent is hereby corrected as shown below:

Claim 18, line 1, delete "1" and insert therefore - - 10 - -.

Signed and Sealed this

Third Day of November, 1998

*Attest:*

*Attesting Officer*

Bruce Lehman

BRUCE LEHMAN

*Commissioner of Patents and Trademarks*